US010858989B2

(12) United States Patent
Tiramani et al.

(10) Patent No.: US 10,858,989 B2
(45) Date of Patent: Dec. 8, 2020

(54) DUAL-ANGLE EXHAUST MANIFOLD

(71) Applicant: Auto IP LLC, Las Vegas, NV (US)

(72) Inventors: Paolo Tiramani, Las Vegas, NV (US); Kyle Denman, North Las Vegas, NV (US)

( * ) Notice: Subject to any disclaimer, the term of this patent is extended or adjusted under 35 U.S.C. 154(b) by 0 days.

(21) Appl. No.: 16/168,971

(22) Filed: Oct. 24, 2018

(65) Prior Publication Data

US 2019/0128170 A1 May 2, 2019

Related U.S. Application Data

(60) Provisional application No. 62/697,072, filed on Jul. 12, 2018, provisional application No. 62/678,460,
(Continued)

(51) Int. Cl.
*F01N 13/10* (2010.01)
*F02B 37/18* (2006.01)
(Continued)

(52) U.S. Cl.
CPC ..... *F02B 37/183* (2013.01); *F01N 13/10* (2013.01); *F01N 13/1805* (2013.01); *F02B 75/22* (2013.01)

(58) Field of Classification Search
CPC .... F02B 37/183; F02B 75/22; F01N 13/1805; F01N 13/10
See application file for complete search history.

(56) References Cited

U.S. PATENT DOCUMENTS 4,184,329 A * 1/1980 Ruesch ..... F01N 13/10 60/322
4,689,952 A * 9/1987 Arthur ..... F01N 13/10 29/428
(Continued)

FOREIGN PATENT DOCUMENTS

CN 104279042 A 1/2015
WO 2016/195573 A1 12/2016

OTHER PUBLICATIONS

NPL-1 https://www.holley.com/products/exhaust/headers_and_exhaust_manifolds/, accessed Jan. 8, 2018 (contents believed available by Dec. 2017).
(Continued)

*Primary Examiner* — Matthew T Largi
(74) *Attorney, Agent, or Firm* — McCarter & English, LLP

(57) ABSTRACT

An exhaust manifold for an internal combustion piston engine with a row of at least two cylinders inclined from the vertical. The exhaust manifold has plural exhaust stack assemblies and a manifold plenum with an outlet. Each of the plural exhaust stack assemblies comprises a leader pipe and an exhaust connector, with a first end of each leader pipe being joined to a first end of the exhaust connector of the exhaust stack assembly, and a second end of each exhaust connector being joined to the manifold plenum. Each leader pipe is joined to a manifold flange that is adapted for joining to the internal combustion engine to receive exhaust gases from the cylinders of the engine. Each leader pipe is joined in a vertical plane to the manifold flange at a first angle so that the plural exhaust stack assemblies are approximately horizontally oriented when joined to the internal combustion engine, and each leader pipe is joined in a horizontal plane
(Continued)

to the manifold flange at a second angle inclined toward the outlet.

17 Claims, 3 Drawing Sheets

Related U.S. Application Data filed on May 31, 2018, provisional application No. 62/616,601, filed on Jan. 12, 2018, provisional application No. 62/598,045, filed on Dec. 13, 2017, provisional application No. 62/577,965, filed on Oct. 27, 2017, provisional application No. 62/577,423, filed on Oct. 26, 2017.

(51) Int. Cl.
*F01N 13/18* (2010.01)
*F02B 75/22* (2006.01)

(56) References Cited

U.S. PATENT DOCUMENTS 4,924,967 A * 5/1990 Ike ..... B23K 35/302 181/240
5,689,954 A 11/1997 Blocker et al.
5,860,278 A * 1/1999 Rodenkirch ..... F01N 13/10 60/274
6,263,672 B1 7/2001 Roby et al.
8,539,768 B2 9/2013 Hayman et al.
9,316,151 B2 4/2016 Keating et al.
10,132,424 B2 11/2018 Graichen et al.
10,151,414 B2 * 12/2018 Micken ..... F04B 53/16
2005/0183414 A1 * 8/2005 Bien ..... F01N 13/10 60/323
2009/0094966 A1 * 4/2009 Huslig ..... F01N 3/10 60/302
2010/0018192 A1 * 1/2010 Suschik ..... F01N 13/10 60/323
2012/0285427 A1 11/2012 Hayman et al.
2018/0156164 A1 6/2018 Keating et al.

OTHER PUBLICATIONS

NPL-2 https://www.holley.com/products/exhaust/headers_and_exhaust_manifolds/exhaust_manifolds/parts/8510HKR, accessed Jan. 8, 2018 (contents believed available by Dec. 2017).
NPL-3 International Search Report dated Jan. 17, 2019, for PCT/US2018/057218.
NPL-4 International Search Report, dated Jan. 4, 2019, for PCT/US2018/057233.
NPL-5 Facebook Post May 7, 2017 <https://www.facebook.com/SupercarSystem/posts/788183328008424:0>.
NPL-6 Facebook Post May 2, 2016 <https://www.facebook.com/SupercarSystem/posts/591367204356705:0>.

* cited by examiner

DUAL-ANGLE EXHAUST MANIFOLD

CROSS-REFERENCES TO RELATED APPLICATIONS

This application claims the benefit of U.S. Provisional Application No. 62/577,423, filed Oct. 26, 2017, U.S. Provisional Application No. 62/577,965, filed Oct. 27, 2017, U.S. Provisional Application No. 62/598,045, filed Dec. 13, 2017, U.S. Provisional Application No. 62/616,601 filed Jan. 12, 2018, U.S. Provisional Application No. 62/678,460, filed May 31, 2018, and U.S. Provisional Application No. 62/697,072, filed Jul. 12, 2018.

BACKGROUND OF THE INVENTION

Field of the Invention

This invention relates to systems for collecting the exhaust from internal combustion engines.

Description of the Related Art

Eight cylinder internal combustion engines are often designed with a "V-8" configuration; i.e., two banks of four cylinders rotating a common crankshaft, where each bank is inclined so as to form a "V". The exhaust gases from each bank of cylinders may be directed by means of an exhaust manifold for discharge to the atmosphere, either directly or through other components.

The design of the exhaust manifold can impact engine power and efficiency.

SUMMARY OF THE INVENTION

The present invention provides a novel exhaust manifold designed to improve engine performance.

In one aspect, the present invention is directed to an exhaust manifold for an internal combustion piston engine that is adapted to be mounted with a row of at least two cylinders inclined from the vertical. The exhaust manifold features plural exhaust stack assemblies and a manifold plenum with an outlet, where each of the plural exhaust stack assemblies comprises a leader pipe and an exhaust connector, and a first end of each leader pipe joins a first end of an exhaust connector, a second end of each exhaust connector joins the manifold plenum, and a second end of each leader pipe joins a manifold flange that is adapted for joining to the internal combustion engine to receive exhaust gases from the cylinders of the engine. Notably, each leader pipe is joined to the manifold flange at a first angle in a vertical plane so that the plural exhaust stack assemblies are approximately horizontally oriented when joined to the internal combustion piston engine, and each leader pipe is joined to the manifold flange at a second angle in a horizontal plane inclined toward the outlet.

In another aspect, the present invention is directed to an exhaust manifold for an internal combustion piston engine with a row of at least two cylinders, where the exhaust manifold features plural exhaust stacks and a generally cylindrical manifold plenum having a generally cylindrical wall with a closed first end and a second end having an exhaust outlet. The diameter of the generally cylindrical manifold plenum changes from the first end to the second end to provide an increasing cylindrical volume from the first end to the second end. Notably, the diameter of the generally cylindrical manifold plenum changes at a non-constant rate from the first end to the second end so that the wall of the manifold plenum generally conforms to an "S" shape in profile from the first end to the second end. A first end of each of the plural exhaust stacks is joined to the manifold plenum, and a second end of each of the plural exhaust stacks joins a manifold flange adapted for joining to the internal combustion engine to receive exhaust gases from the cylinders of the engine These and other aspects of the present invention are described in the drawings annexed hereto, and in the description of the preferred embodiments and claims set forth below.

DETAILED DESCRIPTION OF THE PREFERRED EMBODIMENTS

Figure 1:
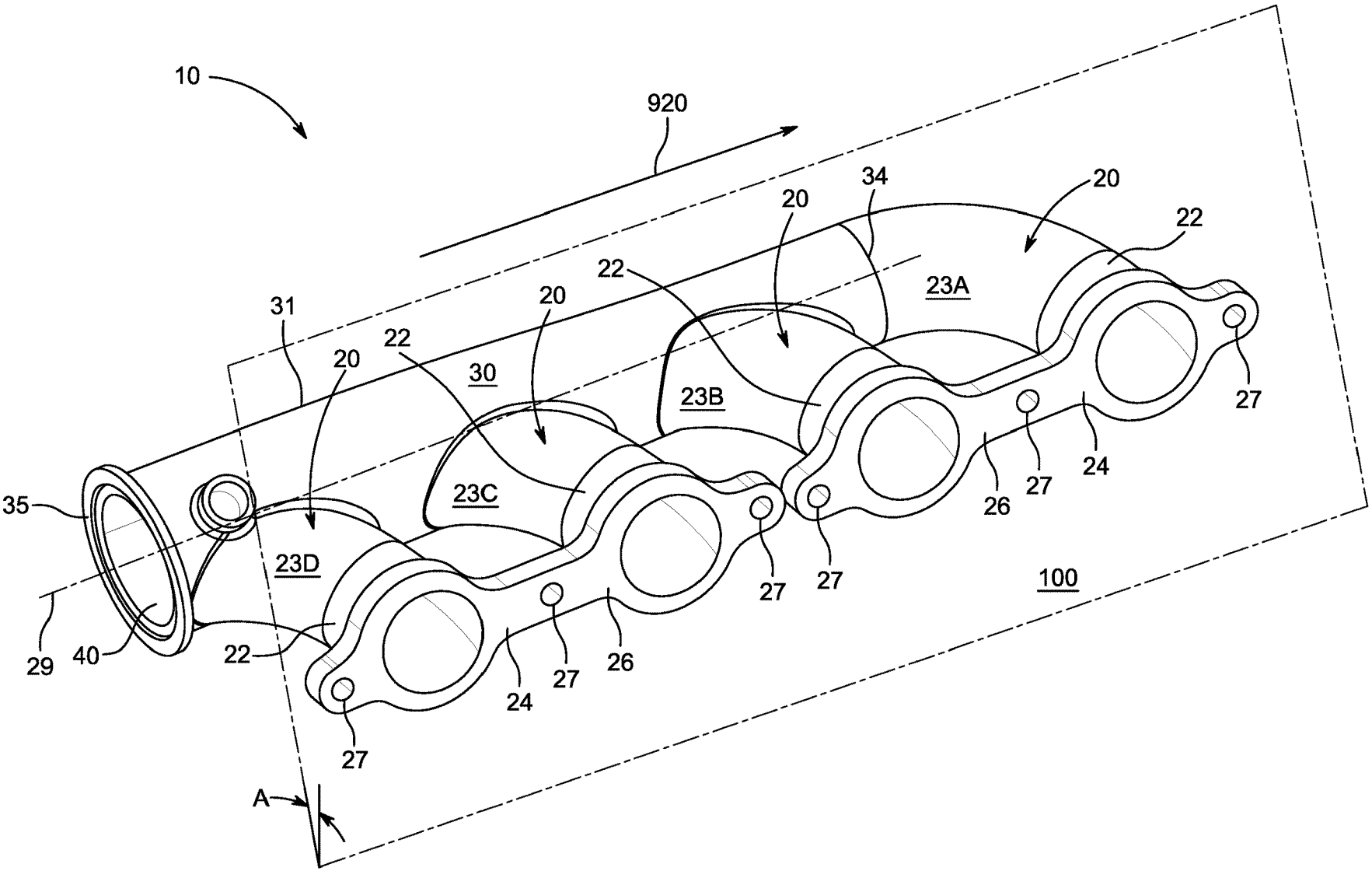
FIG. 1 is a schematic perspective view of the exhaust manifold of the present invention.

In the embodiment of the present invention depicted in FIG. 1, there is shown an exhaust manifold 10. In this disclosure, the direction toward the front of an engine to which exhaust manifold 10 is to be mounted is indicated by arrow 920, shown in FIGS. 1 and 2. Accordingly, references in this disclosure to the "forward" or "front" portion of any component or assemblage, and like references, refers to the portion of the component or assemblage oriented most closely to the head of arrow 920, and reference in this disclosure to the "rearward" or "rear" portion of any component or assemblage, and like references, refers to the portion of the component or assemblage oriented least closely to the head of arrow 920. Furthermore, references in this disclosure to the vertical direction, or like statements, refers to the orientation of a plane normal to the ground (the ground being coincident with the horizontal plane). In the case of V-8 engines mounted in a conventional upright orientation, the vertical direction will coincide with a plane passing through the crankshaft centerline and equidistant from the cylinder banks. Exhaust manifold 10 depicted in FIG. 1 can be secured to the left cylinder bank (facing forward) of an eight cylinder V-8 engine. In that circumstance, the exhaust manifold for the right cylinder bank (not shown) is a mirror image of manifold 10 but otherwise is identical in design, except that the overall length of the exhaust manifolds for the left and right cylinder banks optionally can differ, so as to adjust for V-configuration engines whose left and right cylinder bank discharge ports are offset (typically a consequence of utilizing crankshafts with crankpins arranged along the length of the crankshaft), and result in the rearward ends of each manifold plenum of the exhaust manifolds terminating approximately in the same vertical plane orthogonal to the crankshaft centerline.

Exhaust manifold 10 includes four exhaust stack assemblies 20 that are joined to manifold plenum 30. Exhaust stack assemblies 20 channel exhaust gases from left cylinder bank into manifold plenum 30, which collects and channels the collected gases to exhaust outlet 40, from which the collected gases are directed to energy recovery systems, such as exhaust gas turbines for compressing the intake air, and/or to pollution and/or noise control devices.

Exhaust stack assemblies 20 each comprises a leader pipe 22 and one of exhaust connectors 23A, 23B, 23C and 23D (generically referred to as exhaust connectors 23). The portions of leader pipes 22 proximate the engine are joined to manifold flanges 24. In particular, in the embodiment shown there are two manifold flanges 24, one of which is joined to the forward two leader pipes 22 and the other of which is joined to the rearward two leader pipes 22. Alternative designs in accordance with the present invention include individual flanges 24 joining respective individual leader pipes 22, as well as a single flange 24 joining all leader pipes 22. Each leader pipe 22 has a centerline 25 (see FIGS. 2 and 3) and has a generally circular diameter along the length of centerline 25.

Manifold flanges 24 include engine-side generally planar mating surfaces 26, which form a relatively gas-tight seal when fastened to an engine, and additionally, which define a plurality of apertures 27 that permit exhaust manifold 10 to be fastened (using nuts) to threaded studs extending from the cylinder bank of the engine. The portion of each stack assembly 20 distal from the engine is joined to manifold plenum 30.

Figure 3:
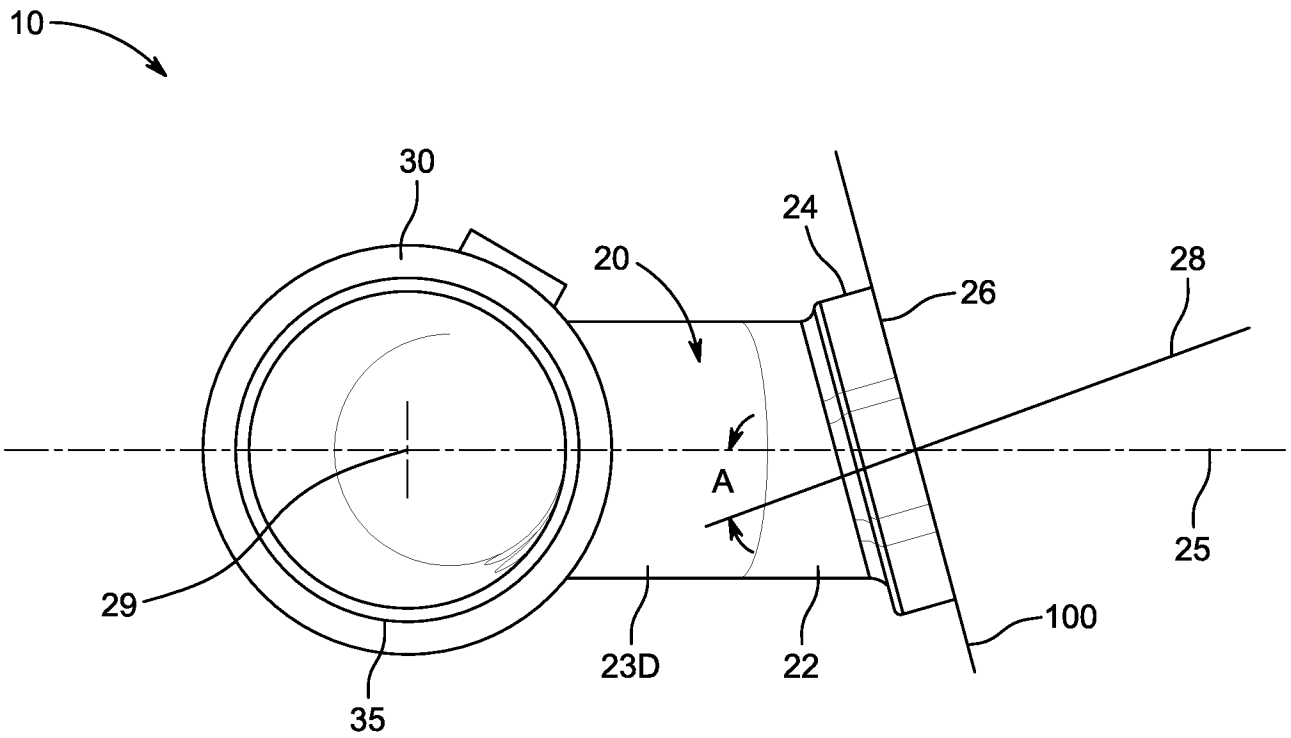
FIG. 3 is a rear view of the exhaust manifold of the present invention.

The engine-side mating surfaces of manifold flanges 24 are oriented parallel to a plane 100, shown in FIGS. 1 and 3. An engine generally will have contact surfaces machined or formed on the engine in a region circumscribing the engine exhaust ports, in order to form a relatively gas-tight seal with appropriate portions of a manifold, which in this embodiment are the engine-side mating surfaces 26 of exhaust manifold 10. For V-8 engines, those contact surfaces generally are inclined from the vertical, for example at an angle V equal to one-half the angle subtended by the cylinder banks; thus, for a V-8 engine, the angle V from the vertical of plane 100 will be for example approximately 22.5°, 30° or 36°.

Figure 2:
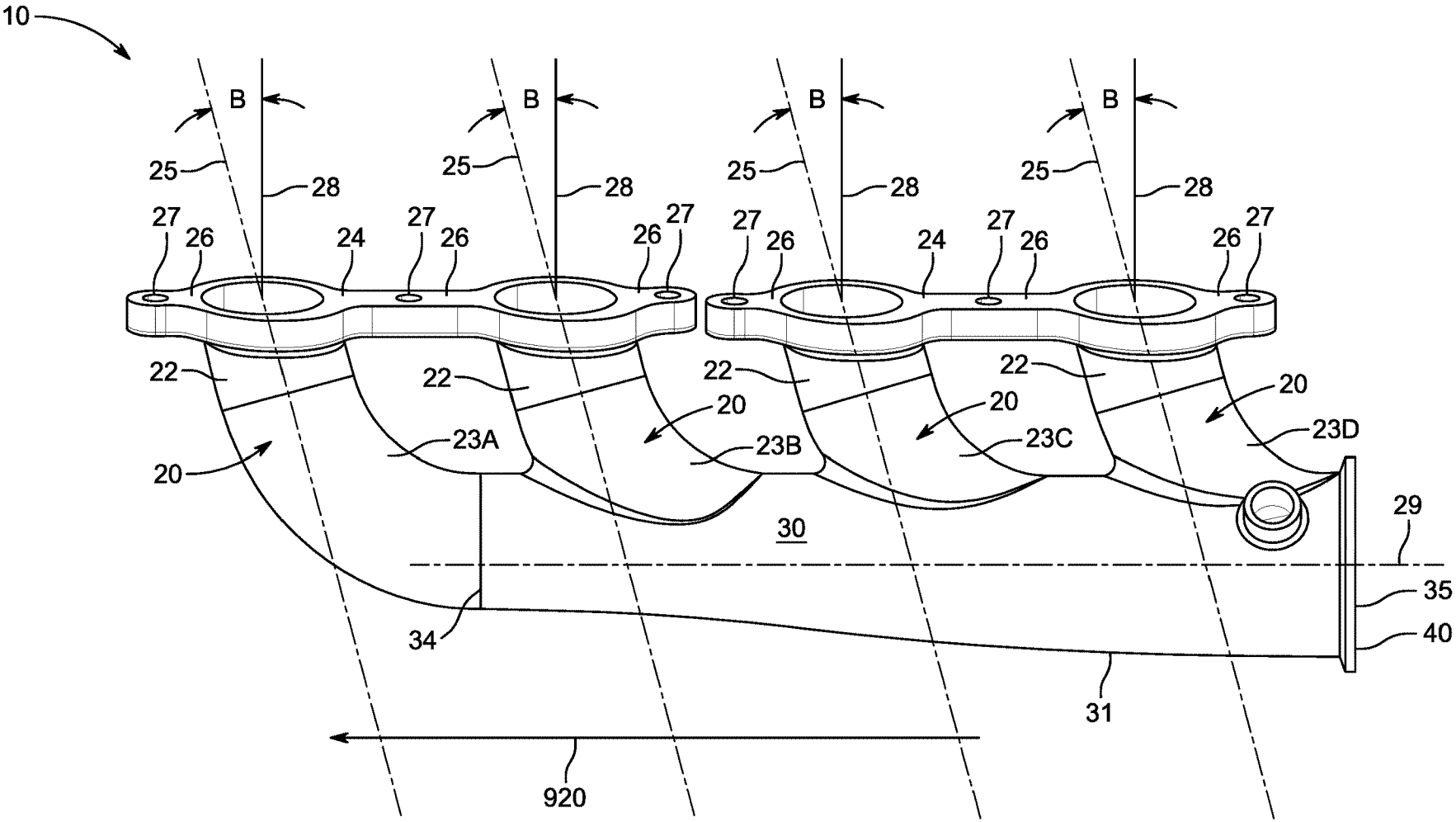
FIG. 2 is a top view of the exhaust manifold of the present invention.

In the present invention, it is preferred that the centerline 25 of each leader pipe 22, as well as the centerlines of exhaust connectors 23, be inclined upwardly at an angle A from a line 28 orthogonal to plane 100, as shown in FIG. 3, so that the exhaust stack assemblies 20 lie generally in a horizontal plane when exhaust manifold 10 is joined to an engine having an inclined cylinder bank. Thus in the rear view of FIG. 3, the centerlines of exhaust connectors 23, as well as centerlines 25, collectively coincide so as to be located in that horizontal plane. In some V-8 engine cases, angle A will be approximately the same as angle V, although the ultimate choice for angle A depends on the orientation of the specific engine contact surfaces. Also, as can be seen in FIG. 2, the centerline of each leader pipe 22 is inclined rearwardly at an angle B from line 28 orthogonal to plane 100. Inclining leader pipes 22 at angles A and B is for purposes of improving engine performance.

In the embodiment shown, the first exhaust connector 23A is a curved pipe of relatively uniform diameter, whereas the diameters of second, third and fourth exhaust connectors 23B, 23C and 23D increase with increasing distance from flanges 24, in order to permit the expansion of the exhaust gases along their length. This increase in diameter is for purposes of reducing cylinder backpressure and improving exhaust gas scavenging during the exhaust cycle. Leader pipes 22 are joined to flange fittings 24 via welding, brazing or by being integrally formed with flange fittings 24. Likewise, exhaust connectors 23 are joined to manifold plenum 30 via welding, brazing or by being integrally formed with manifold plenum 30, and leader pipes 22 are joined to exhaust connectors 23 via welding, brazing or by being integrally formed with connectors 23.

Manifold plenum 30 has a generally elongate cylindrical shape and a generally cylindrical wall 31, as shown in FIGS. 1 and 2. The forward end 34 of manifold plenum 30 is closed off by the first exhaust stack assembly 20 (containing exhaust connector 23A). The rearward end 35 of manifold plenum 30 defines exhaust outlet 40. Manifold plenum 30 is generally circular in cross-section, as shown in FIG. 3. It is preferred that the diameter of manifold plenum 30 become greater along its length; i.e., from the forward end 34 of plenum 30 to the rearward end 35. This growth in diameter yields an expanding cylindrical volume from the forward end 34 to the rearward end 35, which serves to accommodate the introduction of additional exhaust gases from each successive cylinder along the length, as well as to permit the expansion of the exhaust gases.

It is particularly preferred that the rate of diameter growth of manifold plenum 30 not be constant along its length from forward end 34 to rearward end 35. Rather, it is particularly preferred that the growth in diameter of manifold plenum 30 start at zero at forward end 34, then grow at an increasing rate from forward end 34 up to approximately the mid-point between forward end 34 and rearward end 35, then grow at a decreasing rate from that mid-point up to rearward end 35, and again reach a zero growth rate at rear end 35. The result of changing the growth rate in this manner is to generally give an "S" shape to wall 31 in profile, from forward end 34 to rearward end 35, as can be seen in FIG. 2. Put another way, the profile of wall 31 of manifold plenum 30 comes to be defined by an S-shaped curve rotated about the centerline 29 of plenum 30, as in FIG. 2.

Although described with reference to use with a V-8 engine, the present invention has more general application, and can be utilized with any internal combustion piston engine having a row of two or more cylinders inclined from the vertical at an acute angle of approximately 45° or less, such as in-line inclined four, five and six cylinder engines, as well as V-4 engines, V-6 engines, V-12 engines, V-16 engines, etc. Manifold designs generally in accordance with the embodiment of exhaust manifold 10 disclosed herein are utilizable in some of the engine configurations disclosed in U.S. Provisional Patent Application No. 62/697,072 entitled "Customizable Engine Air Intake/Exhaust Systems" and filed Jul. 12, 2018, and in U.S. patent application Ser. No. 16/168,984, entitled "Customizable Engine Air Intake/Exhaust Systems," having the same inventors as the subject application and filed on the same date as the subject application.

As is more particularly disclosed in that provisional application and that utility patent application, an exhaust manifold having a design generally corresponding to exhaust manifold 10 as described herein can be paired with a second exhaust manifold of like design, or can be paired with a different exhaust manifold, such as one following the design disclosed in U.S. Provisional Application No. 62/678,460, entitled "Turbocharger Exhaust Manifold with Turbine Bypass Outlet," filed May 31, 2018, according to the particular engine configuration, and disclosed in U.S. patent application Ser. No. 16/168,999, issued as U.S. Pat. No. 10,570,813, entitled "Turbocharger Exhaust Manifold with Turbine Bypass Outlet," having the same inventors as the subject application and filed on the same date as the subject application, again according to the particular engine configuration. The contents of U.S. Provisional Application No. 62/697,072, are hereby incorporated by reference as if fully set forth herein. The contents of U.S. patent application Ser. No. 16/168,984, entitled "Customizable Engine Air Intake/Exhaust Systems," having the same inventors as the subject application and filed on the same date as the subject application, are hereby incorporated by reference as if fully set forth herein, including, as disclosed therein, the exhaust manifold design generally corresponding to exhaust manifold 10, and the different engine configurations and components disclosed therein utilizing or functioning in conjunction with such exhaust manifold design, found for example at paragraphs 53-70, 72-108, 110-154, 156-163 and FIGS. 1-26. The contents of U.S. Provisional Application No. 62/678,460 are hereby incorporated by reference as if fully set forth herein. The contents of U.S. patent application Ser. No. 16/168,999, issued as U.S. Pat. No. 10,570,813, entitled "Turbocharger Exhaust Manifold with Turbine Bypass Outlet," having the same inventors as the subject application and filed on the same date as the subject application, are also hereby incorporated by reference as if fully set forth herein, including, as disclosed therein, the aforementioned manifold design that can be paired with an exhaust manifold having a design generally corresponding to exhaust manifold 10, such aforementioned manifold design found for example at paragraphs 14-48 and FIGS. 1-5 thereof.

The foregoing detailed description is for illustration only and is not to be deemed as limiting the inventions, which are defined in the appended claims.

What is claimed is:

1. An exhaust manifold for an internal combustion piston engine adapted to be mounted with a row of at least two cylinders inclined from the vertical, the exhaust manifold comprising:

plural exhaust stack assemblies;

a manifold plenum with an outlet;

each of the plural exhaust stack assemblies comprising a leader pipe and an exhaust connector, a first end of each leader pipe joined to a first end of the exhaust connector of the exhaust stack assembly, a second end of each exhaust connector joined to the manifold plenum;

a second end of each leader pipe joined to a manifold flange, the manifold flange adapted for joining to the internal combustion piston engine to receive exhaust gases from the at least two cylinders of the internal combustion piston engine;

each leader pipe joined to the manifold flange at a non-zero first angle in a vertical plane so that the plural exhaust stack assemblies are approximately horizontally oriented when joined to the internal combustion piston engine; and each leader pipe joined to the manifold flange at a second angle in a horizontal plane inclined toward the outlet.

2. The exhaust manifold as in claim 1, wherein the surface of the manifold plenum is a generally axisymmetric solid of revolution defined by an S-shaped curve rotated about the axis of the manifold plenum.

3. The exhaust manifold as in claim 1, wherein the manifold plenum has a forward end distal from the outlet, and the second end of the exhaust connector of a first exhaust stack assembly of the plural exhaust stack assemblies is joined to the manifold plenum at the forward end, and the exhaust connector of the first exhaust stack assembly is a curved pipe of relatively uniform diameter.

4. The exhaust manifold as in claim 3, wherein the diameter of the exhaust connector of each of the other or others of the plural exhaust stack assemblies increases from the first end of the exhaust connector to the second end of the exhaust connector.

5. The exhaust manifold as in claim 1, wherein the non-zero first angle is in the range of from about 22.5° to about 36°.

6. The exhaust manifold as in claim 1, wherein the non-zero first angle is about 22.5°.

7. The exhaust manifold as in claim 1, wherein the plural exhaust stack assemblies comprise four exhaust stack assemblies.

8. An engine-exhaust manifold assembly, comprising:

(a) an internal combustion piston engine, comprising;

(1) a crankshaft with a crankshaft centerline;

(2) the internal combustion piston engine adapted to be positioned in an upright orientation in which the crankshaft centerline is positioned in a vertical plane, the internal combustion piston engine when so positioned having:

(i) a first cylinder bank of at least two cylinders inclined relative to the vertical plane, the first cylinder bank including a first plurality of discharge ports, and a first plurality of manifold mating surfaces inclined relative to the vertical plane at a non-zero first angle;

(ii) a second cylinder bank of at least two cylinders, inclined relative to the vertical plane, the second cylinder bank including a second plurality of discharge ports, and a second plurality of manifold mating surfaces inclined relative to the vertical plane at a non-zero second angle;

(iii) the first and second cylinder banks forming a V configuration with the vertical plane being approximately equidistant between the first and second cylinder banks;

(b) a first exhaust manifold comprising:

(1) a first manifold plenum with an outlet;

(2) a first manifold flange arrangement having one or more engine mating surfaces oriented parallel to a first engine contact plane, the one or more engine mating surfaces of the first manifold flange arrangement being joined to the first plurality of manifold mating surfaces of the first cylinder bank;

(3) a first plurality of exhaust stack assemblies, wherein:

(i) each of the exhaust stack assemblies of the first plurality of exhaust stack assemblies is joined to the first manifold flange arrangement and to the first manifold plenum;

(ii) each of the exhaust stack assemblies of the first plurality of exhaust stack assemblies defines a passageway for receiving exhaust gases from a respective one of the first plurality of discharge ports and conducting those exhaust gases to the first manifold plenum; and (iii) each of the exhaust stack assemblies of the first plurality of exhaust stack assemblies includes a leader pipe joined to the first manifold flange arrangement; and wherein:

(iv) each leader pipe of each of the exhaust stack assemblies of the first plurality of exhaust stack assemblies is joined to the first manifold flange arrangement at the non-zero first angle relative to a line orthogonal to the first engine contact plane so that the first plurality of exhaust stack assemblies are approximately horizontally oriented when the internal combustion piston engine is positioned in the upright orientation; and (v) each leader pipe of each of the exhaust stack assemblies of the first plurality of exhaust stack assemblies being joined to the first manifold flange arrangement at a third angle in a horizontal plane inclined toward the outlet of the first manifold plenum.

9. The engine-exhaust manifold assembly as in claim 8, wherein:

the first plurality of exhaust stack assemblies comprises four exhaust stack assemblies;

the first manifold flange arrangement comprises a first manifold flange having a first engine mating surface oriented parallel to the first engine contact plane, and a second manifold flange having a second engine mating surface oriented parallel to the first engine contact plane;

a first leader pipe of a first exhaust stack assembly of the four exhaust stack assemblies of the first plurality of exhaust stack assemblies is joined to the first manifold flange; and a second leader pipe of a second exhaust stack assembly of the four exhaust stack assemblies of the first plurality of exhaust stack assemblies is joined to the first manifold flange.

10. The engine-exhaust manifold assembly as in claim 9, wherein:

a third leader pipe of a third exhaust stack assembly of the four exhaust stack assemblies of the first plurality of exhaust stack assemblies is joined to the second manifold flange; and a fourth leader pipe of a fourth exhaust stack assembly of the four exhaust stack assemblies of the first plurality of exhaust stack assemblies is joined to the second manifold flange.

11. The engine-exhaust manifold assembly as in claim 8, wherein:

the first plurality of exhaust stack assemblies comprises a first exhaust stack assembly, a second exhaust stack assembly, a third exhaust stack assembly and a fourth exhaust stack assembly;

the first manifold flange arrangement comprises a first manifold flange having a first engine mating surface oriented parallel to the first engine contact plane, a second manifold flange having a second engine mating surface oriented parallel to the first engine contact plane, a third manifold flange having a third engine mating surface oriented parallel to the first engine contact plane, and a fourth manifold flange having a fourth engine mating surface oriented parallel to the first engine contact plane; and wherein:

a first leader pipe of the first exhaust stack assembly of the first plurality of exhaust stack assemblies is joined to the first manifold flange, a second leader pipe of the second exhaust stack assembly of the first plurality of exhaust stack assemblies is joined to the second manifold flange, a third leader pipe of the third exhaust stack assembly of the first plurality of exhaust stack assemblies is joined to the third manifold flange, and a fourth leader pipe of the fourth exhaust stack assembly of the first plurality of exhaust stack assemblies is joined to the fourth manifold flange.

12. The engine-exhaust manifold assembly as in claim 8, wherein the surface of the first manifold plenum is a generally axisymmetric solid of revolution defined by an S-shaped curve rotated about the axis of the manifold plenum.

13. The engine-exhaust manifold assembly as in claim 8, wherein the non-zero first angle is in the range of from about 22.5° to about 36°.

14. The engine-exhaust manifold assembly as in claim 8, wherein the non-zero first angle is about 22.5°.

15. The engine-exhaust manifold assembly as in claim 8, wherein:

the first plurality of exhaust stack assemblies comprises a first exhaust stack assembly, a second exhaust stack assembly, a third exhaust stack assembly and a fourth exhaust stack assembly;

the first manifold flange arrangement comprises a first manifold flange having an engine mating surface oriented parallel to the first engine contact plane, a first leader pipe of the first exhaust stack assembly of the first plurality of exhaust stack assemblies is joined to the first manifold flange, a second leader pipe of the second exhaust stack assembly of the first plurality of exhaust stack assemblies is joined to the first manifold flange, a third leader pipe of the third exhaust stack assembly of the first plurality of exhaust stack assemblies is joined to the first manifold flange, and a fourth leader pipe of the fourth exhaust stack assembly of the first plurality of exhaust stack assemblies is joined to the first manifold flange.

16. The engine-exhaust manifold assembly as in claim 8, further comprising:

(c) a second exhaust manifold comprising:

(1) a second manifold plenum with an outlet;

(2) a second manifold flange arrangement having one or more engine mating surfaces oriented parallel to a second engine contact plane, the one or more engine mating surfaces of the second manifold flange arrangement being joined to the second plurality of manifold mating surfaces of the second cylinder bank;

(3) a second plurality of exhaust stack assemblies, wherein:

(i) each of the exhaust stack assemblies of the second plurality of exhaust stack assemblies is joined to the second manifold flange arrangement and to the second manifold plenum;

(ii) each of the exhaust stack assemblies of the second plurality of exhaust stack assemblies defines a passageway for receiving exhaust gases from a respective one of the second plurality of discharge ports and conducting those exhaust gases to the second manifold plenum; and (iii) each of the exhaust stack assemblies of the second plurality of exhaust stack assemblies includes a leader pipe joined to the second manifold flange arrangement; and wherein:

(iv) each leader pipe of each of the exhaust stack assemblies of the second plurality of exhaust stack assemblies is joined to the second manifold flange arrangement at the non-zero second angle relative to a line orthogonal to the second engine contact plane so that the second plurality of exhaust stack assemblies are approximately horizontally oriented as joined to the internal combustion piston engine; and (v) each leader pipe of each of the exhaust stack assemblies of the second plurality of exhaust stack assemblies is joined to the second manifold flange arrangement at the third angle in a horizontal plane inclined toward the outlet of the second manifold plenum.

17. The engine-exhaust manifold assembly as in claim 16, wherein the first exhaust manifold has a first overall length, and the second exhaust manifold has a second overall length different than the first overall length.

* * * * *